US008386084B2

(12) United States Patent
Koba et al.

(10) Patent No.: US 8,386,084 B2
(45) Date of Patent: Feb. 26, 2013

(54) GAS SHUTOFF DEVICE

(75) Inventors: Yasuo Koba, Nara (JP); Kouichi Ueki, Nara (JP); Kazutaka Asano, Nara (JP); Takuhisa Ootani, Nara (JP)

(73) Assignee: Panasonic Corporation, Osaka (JP)

( * ) Notice: Subject to any disclaimer, the term of this patent is extended or adjusted under 35 U.S.C. 154(b) by 537 days.

(21) Appl. No.: 12/668,754

(22) PCT Filed: Mar. 7, 2008

(86) PCT No.: PCT/JP2008/000496

§ 371 (c)(1),
(2), (4) Date: Jan. 12, 2010

(87) PCT Pub. No.: WO2009/008107

PCT Pub. Date: Jan. 15, 2009

(65) Prior Publication Data

US 2010/0170582 A1 Jul. 8, 2010

(30) Foreign Application Priority Data

Jul. 12, 2007 (JP) ..... P2007-182929

(51) Int. Cl.
*G05D 11/00* (2006.01)

(52) U.S. Cl. ..... 700/282; 137/382; 604/540; 702/45

(58) Field of Classification Search ..... 700/282; 702/45; 137/382; 604/540
See application file for complete search history.

(56) References Cited

U.S. PATENT DOCUMENTS

| | | | | |
|---|---|---|---|---|
| 4,839,790 | A * | 6/1989 | Fujimoto et al. | 700/79 |
| 4,866,633 | A * | 9/1989 | Nakane et al. | 700/282 |
| 5,126,934 | A * | 6/1992 | MacFadyen | 700/11 |
| 6,269,829 | B1 * | 8/2001 | Chen et al. | 137/38 |
| 7,809,514 | B2 | 10/2010 | Miyata et al. | |
| 2003/0079774 | A1 * | 5/2003 | Reyman | 137/38 |
| 2003/0193404 | A1 * | 10/2003 | Joao | 340/825.71 |
| 2004/0128034 | A1 * | 7/2004 | Lenker et al. | 700/282 |
| 2006/0174707 | A1 * | 8/2006 | Zhang | 73/592 |
| 2006/0271242 | A1 * | 11/2006 | Shturman et al. | 700/282 |

(Continued)

FOREIGN PATENT DOCUMENTS

| | | |
|---|---|---|
| EP | 1881304 A1 | 1/2008 |
| JP | 62-198717 A | 9/1987 |

(Continued)

OTHER PUBLICATIONS

Extended European Search Report for European Application No. 08720382.4, dated Nov. 9, 2011, 7 pages.

(Continued)

*Primary Examiner* — Mohammad Ali
*Assistant Examiner* — Anthony Whittington
(74) *Attorney, Agent, or Firm* — Brinks Hofer Gilson & Lione

(57) ABSTRACT

An object is to prevent a mistaken shutoff caused by the mistaken registration of an appliance of which an amount of gas used changes. An individual flow registration maintenance unit maintains a registered flow rate deleted due to an increase/decrease in flow rate, again, performs determination on the flow rate maintained when a new flow rate is registered or a flow rate added with the maintained flow rate, and in the case where it is regarded to be the same, re-register the maintained flow rate.

4 Claims, 7 Drawing Sheets

U.S. PATENT DOCUMENTS

| | | | | |
|---|---|---|---|---|
| 2007/0219532 | A1* | 9/2007 | Karpowicz et al. | 604/540 |
| 2008/0185049 | A1* | 8/2008 | Mulligan et al. | 137/382 |

FOREIGN PATENT DOCUMENTS

| | | | |
|---|---|---|---|
| JP | 03-237986 | A | 10/1991 |
| JP | 05-067284 | A | 3/1993 |
| JP | 05-134762 | A | 6/1993 |
| JP | 07-044239 | A | 2/1995 |
| JP | 07-044240 | A | 2/1995 |
| JP | 2002-174542 | A | 6/2002 |
| WO | WO 2006/121004 | A1 | 11/2006 |

OTHER PUBLICATIONS

International Search Report for International Application No. PCT/JP2008/000496, dated Apr. 1, 2008, 1 page.

* cited by examiner

GAS SHUTOFF DEVICE

TECHNICAL FIELD

The present invention relates to a gas shutoff device, and more particularly, to a flow registration function.

BACKGROUND ART

In the past, as a gas shutoff device of this type, a gas shutoff device including a flow measurement unit for outputting a flow signal corresponding to the amount of gas passing through, an individual appliance estimation unit for estimating an increase/decrease of the use of an individual appliance when the flow signal is increased/decreased, and outputting an estimated individual calculation flow rate of the increased/decreased appliance and use time, an individual flow registration unit for registering a flow rate of an individual appliance being used in advance and outputting the registered individual flow rate and the use time, an individual flow storage unit for storing the registered individual flow rate, an abnormal flow determination unit for outputting an individual error signal in the case where the estimated individual calculation flow rate of the increased/decreased appliance is not included in the registered individual flow rate of the individual flow storage unit, and the continuous use time of the increased/decreased appliance is equal to or longer than a first predetermined time, a notification unit for producing a warning notification regarding an error in gas flow rate, or a shutoff unit for shutting a gas passageway on the basis of receiving the individual error signal, and an ordinary individual flow registration unit for registering the estimated individual calculation flow rate of the individual flow estimation unit in the individual flow storage unit in the case where the estimated individual calculation flow rate of the appliance of the individual appliance estimation unit is not included in the registered individual flow rate of the individual flow storage unit, and the use time of the appliance of the individual appliance estimation unit is longer than a second predetermined time and shorter than the first predetermined time, is disclosed (for example, refer to Patent Document).

When the gas shutoff device of Patent Document 1 is briefly described with reference to FIG. 5, reference numeral 101 denotes a flow measurement unit as a flow sensor mounted to a gas meter. Reference numeral 102 denotes an individual appliance estimation unit for calculating a flow signal s of a flow sensor 1 as an average flow rate of a predetermined measurement period (30 seconds), estimating an increase/decrease in the individual flow rate in use on the basis of the increase/decrease in the average flow rate, and outputting an estimated individual calculation flow rate Q of the increased/decreased appliance and a use time. This individual appliance estimation unit 102 determines that a gas appliance is used on the basis of the increase when the average flow rate increases, and determines that the gas appliance is stopped on the basis of the decrease in the case where the average flow rate decreases, to estimate the usage of the individual appliance. Reference numeral 103 denotes an individual flow registration unit as a setting unit for inputting a flow rate (Qi) of an individual appliance used at home in advance. Reference numeral 104 denotes an individual flow storage unit for storing the flow rate (Qi) of the individual appliance of the individual flow registration unit 103 and flow rates of the ordinary individual flow registration unit 107 sequentially as Q1, Q2, Q3, . . . , Qn. Reference numeral 105 denotes an abnormal flow determination unit for outputting an individual error signal E when the estimated individual flow rate Q output from the individual appliance estimation unit 102 is not included in {Q1, Q2, Q3, . . . , Qn} of the individual flow storage unit 104 and the estimated individual flow rate Q is continued for more than the first predetermined time (10 minutes). Reference numeral 106 denotes a notification unit or a shutoff unit including an LCD or an LED for giving a warning notification or a shutoff valve for shutting the gas passageway on the basis of receiving the individual error signal E. Reference numeral 107 denotes an ordinary individual flow registration unit for outputting the estimated individual flow rate Q to the individual flow storage unit 104 in the case where the estimated individual flow rate Q output from the individual flow estimation unit 102 is the second predetermined time (3 minutes) or more or the first predetermined time (10 minutes) or less.

Next, the operation of the configuration of the prior example will be described. An average flow rate is calculated on the basis of the flow signal of the flow measurement unit 101. A change in flow rate between the average flow rate and an average flow rate at the time before last measurement is obtained to determine whether the change is an increase or a decrease, and an estimated individual calculation flow rate Q is obtained by a corresponding process. It is determined whether or not the estimated individual calculation flow rate Q that newly appears as a result of the increase/decrease process is included in the individual flow storage unit 104, or used for the first predetermined time (10 minutes). When it is not included and it is used for 10 minutes or more, the notification unit or the shutoff unit 106 is operated. When it is not included or not used for 10 minutes or more, it is determined whether or not it is a non-registered flow rate, it is used for 3 minutes or more, the use time is 10 minutes or less, and when all are in conformity, the ordinary individual flow registration unit 107 performs registration processing on the individual flow storage unit 104.

Now, in the case where there is an increase in average flow rate as Qt (for example, Q2+Q3) due to the simultaneous use of a plurality of appliances, and the use time is for example 7 minutes, that is, the average flow rate decreases after 7 minutes, an estimated individual flow rate Qt is output from the individual appliance estimation unit 102. This estimated individual flow rate Qt is registered in the individual flow storage unit 104 by the ordinary individual flow registration unit 107 such that the use time is equal to or longer than 3 minutes or equal to or less than 10 minutes. Thereafter, it is registered in the individual flow registration unit 104, so that there is no shutoff even though the flow rate appears for 10 or more minutes. That is, error shut-off caused by gas appliances that start operating at the same time in many cases can be reduced. In addition, in the case where there is a new individual flow rate Qk (3 minutes or longer or 10 minutes or less) due to appliance replacement, an estimated individual flow rate Qk is output from the individual appliance estimation unit 102. The estimated individual flow rate Qk is registered in the individual flow storage unit 104 by the ordinary individual flow registration unit 107 such that the use time is 3 minutes or longer or 10 minutes or less.

Thereafter, since it is registered in the individual flow storage unit 104, there is no shutoff even though the flow rate appears for 10 or more minutes. Individual appliances used at each home are stored in advance, and accidents caused by gas leakage due to a flow rate other than the individual appliances can be prevented in advance, and error shutoff caused by the simultaneous start of the appliances or appliance replacement can be prevented.

In addition, as illustrated in FIG. 6, there is provided a flow measurement unit 1 for outputting a flow signal according to the amount of gas passing through, an individual appliance calculation unit 2 for calculating an average flow rate for a predetermined period upon receiving the flow signal transmitted from the flow measurement unit 1, calculating an increase/decrease in the appliance in use by calculating an increase/decrease in the average flow rate at predetermined times, and outputting the calculation flow rate of the increased/decreased appliance, an individual appliance registration unit 6 for registering the calculation flow rate of the increased/decreased appliance and outputting a maximum individual calculation flow rate, and a shutoff unit for receiving the maximum individual calculation flow rate, receiving an individual error signal from the abnormal flow determination unit for outputting the individual error signal in the case where the continuous use time of the appliance continues for a predetermined time or more, and outputting a shutoff signal to the gas passageway. The flowchart of flow rate registration and flow rate deletion procedures of the individual appliance registration unit 6 is illustrated in FIG. 7 (for example, refer to Patent Document 2).

[Patent Document 1] JP-A-7-44239

[Patent Document 2] JP-A-5-134762

DISCLOSURE OF THE INVENTION

Problem that the Invention is to Solve

In recent years, there have been appliances that use and control a flow rate among gas appliances. In the case where an appliance using a large amount of gas such as a water heater controls a flow rate, when an appliance having a small amount of gas used such as a gas fan heater is used simultaneously, there may be a case where the gas shutoff device considers the change in flow rate caused by the control as relating to an appliance having a small gas flow rate, and deletes the flow rate of the appliance having the small gas flow rate as individual appliance registration function. In this case, when the use of the appliance having the large amount of gas used is stopped, it is re-registered as a new flow rate, however, in the case where two or more small appliances are simultaneously used or the like, it is estimated as a single appliance, so that a flow rate larger than the actual flow rate is registered thereby causing shutoff due to error.

According to the invention, in an individual flow registration function of registering or deleting a change amount in a flow rate due to a change in flow rate in or from a gas shutoff device, the flow rate deleted from the individual appliance registration unit due to the change in flow rate is maintained, and in the case where the maintained flow rate or the sum of maintained flow rates is regarded as the same as a new flow rate when a change in flow rate re-occurs, although the deleted flow still occurs, it is not a new flow rate but the maintained flow rate which is registered in the individual appliance registration unit, so that estimating the simultaneous use of two or more appliances as a single appliance can be prevented, thereby preventing a security operation from being performed in a time shorter than the actual continuous time.

In addition, the conventional configuration has the following problems. During the use of an appliance, for example, during a shower, there is a case where since a water heater controls a gas flow rate in order to maintain a set hot water temperature according to temperature deviation or a fan heater or the like controls a gas flow rate in order to maintain a predetermined room temperature, an estimated individual calculation flow rate obtained by the individual appliance estimation unit at the time of starting use and registered in the individual flow registration unit gradually decreases under the control, and when the use of an appliance on the other side is stopped during the use of a plurality of appliances or a large change in flow rate occurs, the estimated individual calculation flow rate is re-registered in the individual flow registration unit. However, in the case where the actual flow rate and the sum of the registered flow rates are different, there is a problem in that monitoring of the differing use flow rate is performed and error shutoff cannot be prevented. In addition, an individual flow registration method to cope with this case is not disclosed.

In order to solve the problems, an object of the invention is to provide a gas shutoff device capable of monitoring a use state of a gas appliance on the basis of an accurate flow rate by monitoring a slight change in the flow rate of an appliance and registering the appliance flow rate by obtaining an actual flow rate so as to ensure safety and not cause error shutoff.

Means for Carrying Out the Invention

According to a first aspect of the invention, there is provided a gas shutoff device including: a flow measurement unit for measuring the amount of gas passing through; an individual appliance calculation unit for calculating an increase/decrease in individual appliance when the flow signal is increased/decreased and outputting an individual calculation flow rate of the increased/decreased individual appliance; an individual appliance registration maintenance unit for registering the individual calculation flow rate and outputting a maximum individual calculation flow rate, maintaining the decreased individual calculation flow rate, when the calculation flow rate is decreased/decreased and a flow rate that is not registered is to be registered, determining whether or not it is the maintained flow rate or the sum flow rate of the maintained flow rates, and when it is regarded as the same result as a result of the determination, re-registering the maintained flow rate such that it is not decreased; an abnormal flow determination unit for receiving the maximum individual calculation flow rate and outputting an individual error signal in the case where the continuous use time of the appliance continues for a predetermined time or longer; and a notification unit for giving a warning notification regarding an error of the gas flow rate or a shutoff unit for shutting a gas passageway on the basis of receiving the individual error signal, wherein the registered flow rate that was deleted once due to a decrease in flow rate is maintained, and when the flow rate is regarded as the same, re-registered, so that the simultaneous use of two or more appliances is prevented from being estimated as a single appliance, thereby preventing a security operation from being performed in a shorter time than the actual continuous time.

In addition, in order to accomplish the object, according to the invention, the flow rate is detected by the flow detection unit when a gas appliance is used, and the average flow rate is obtained by the average flow calculation unit whenever the average timekeeping unit passes, so that although a new use is determined from a change in the use flow rate by the flow change detection unit and the change in the flow rate is registered by the flow registration unit, in the case of a small change in flow rate which is not determined as a flow rate change by the flow change detection unit under the control of the appliance itself, the sum flow rate and the sum of the total registered flow rates are compared regularly by the flow difference correction estimation unit every average time measured by the average timekeeping unit and the registered flow rate value is re-corrected and registered, and in the case where the registration of the largest flow rate is corrected by the flow registration unit, the use time error determination unit is not allowed to be re-count the use time by the monitoring correction unit so as to continuously perform use time monitoring.

Accordingly, even though the flow rate actually used is changed, the flow rate can be accurately detected under the control of the appliance itself to determine whether or not there is an error, so that the safety margin is very high, utilization can be enhanced without the gas company being made to come out unnecessarily due to an error shutoff caused by an error in which the actual appliance flow rate is monitored as a different flow rate, thereby improving security.

In order to solve the problem, according to the invention, when a gas appliance is used, the flow detection unit detects a flow rate, the average flow calculation unit obtains an average flow rate, the flow change detection unit determines a new use from a change in the flow rate used to allow the flow registration unit to register the change in flow rate, the error determination unit monitors and determines whether or not it is a normal use state by comparing the maximum registered flow rate with a monitoring value of the monitoring value storage unit. In the case where there is a slight change in the flow rate which is not determined as a change in flow rate by the flow change detection unit due to the control of the appliance itself, when a slight change in the flow rate is detected by comparing the average flow rate stored at the time of registration after the change in flow rate of the flow estimation unit and the current average flow rate, the average flow rate stored at the time of flow registration after detecting a subsequent change in flow is output to the flow registration unit to allow the flow registration unit to obtain a change in the flow rate from the stored average flow rate and the obtained flow rate and register the registered flow rate value, and additionally the error determination unit monitors and determines the monitoring storage value and the registered flow rate to allow the shutoff unit to shut the passage when an error occurs.

Accordingly, there is even a case where there is a slight change in flow rate which is not determined as a flow rate change by the flow change detection unit under the control of the appliance itself, since the flow estimation unit stores the average flow rate at the time of registration, the flow rate is registered so that the flow rate that actually occurs at the time of registration of a subsequent flow rate and the sum of the total registered flow rates of the flow registration unit are always equal to each other, so that the flow rate in actual use can be accurately perceived and monitored.

Advantage of the Invention

As is apparent from the above description, the gas shutoff device of the invention prevents the simultaneous use of two or more appliances from being estimated as a single appliance during the use of a combination of an appliance using a large amount of gas and an appliance using a small amount of gas which are controlled by changing a flow rate, thereby preventing a security operation from being performed in a time shorter than the actual continuous time.

In addition, as described above, according to the invention, even when a flow rate in actual use is changed by the control of the appliance itself, the flow rate can be accurately detected to monitor whether or not there is an error, so that safety margin is very high, utilization can be enhanced without the gas company coming out unnecessarily due to an error shutoff caused by an error in which the actual appliance flow rate is monitored as a different flow rate, thereby improving security.

As described above, according to the invention, when a gas appliance is used and the flow detection unit detects a flow rate, the average flow calculation unit obtains an average flow rate, and although a new use is determined from a change in the flow rate used detected by the flow change detection unit and the change in the flow rate is registered in the flow registration unit, there is a case where there is a small change in flow rate which is not determined as a flow rate change by the flow change detection unit under the control of the appliance itself, so that in the case where the average flow rate at the time of flow registration is stored by the flow estimation unit after the flow rate change detection and the flow rate difference between the average flow rate obtained by the average flow calculation unit every time thereafter and the average flow rate stored in the flow estimation unit is not in a predetermined range, the average flow rate stored in the flow registration unit at the time of previous registration in the flow registration unit is output from the flow estimation unit and calculated as a change in the flow rate from the time of registration, and the sum of the registered flow rate values becomes equal to the actual flow rate (obtained by the average flow rates). That is, the flow rate value before the slight change is registered as the registered flow rate value, the change in flow rate is obtained from the time point, and a flow rate corresponding to the change in flow rate or the closest flow rate is reduced or deleted from the registered flow rate values. Therefore, even though the flow rate actually used is changed, the flow rate can be accurately detected under the control of the appliance itself to determine whether or not an error occurs, so that safety margin is very high, utilization can be enhanced without the gas company coming out unnecessarily due to an error shutoff caused by an error in which the actual appliance flow rate is monitored as a different flow rate, thereby improving security.

Figure 1:
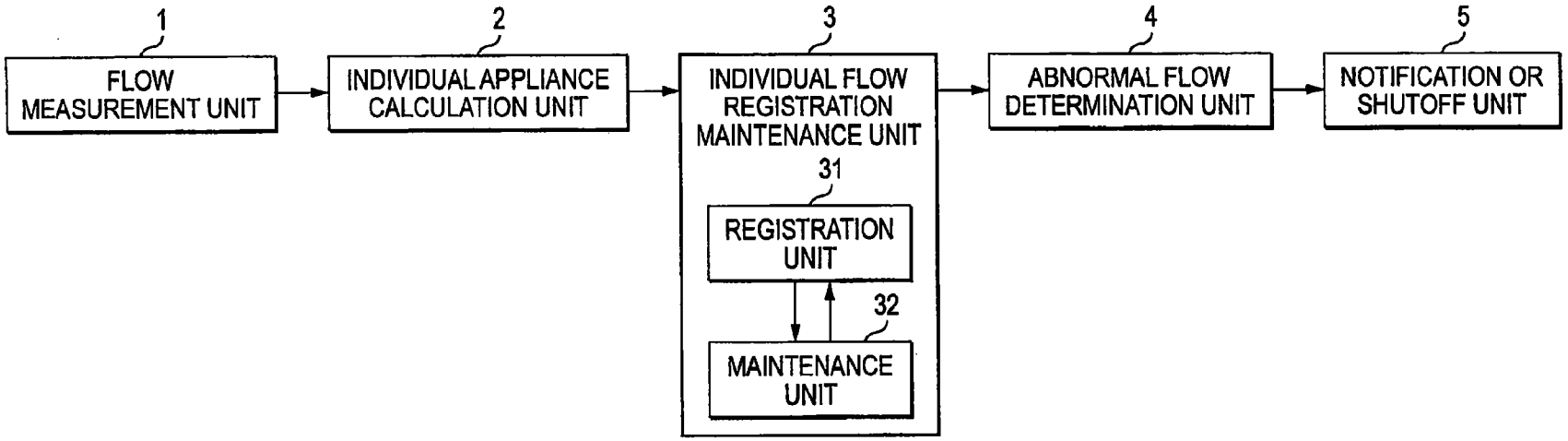
FIG. 1 is a block diagram of a gas shutoff device according to a first embodiment of the invention.

DESCRIPTION OF REFERENCE NUMERALS AND SIGNS (FIGS. 1 and 2)
1: FLOW MEASUREMENT UNIT
2: INDIVIDUAL FLOW CALCULATION UNIT
3: INDIVIDUAL FLOW REGISTRATION MAINTENANCE UNIT
4: ABNORMAL FLOW DETERMINATION UNIT
5: NOTIFICATION OR SHUTOFF UNIT
6: INDIVIDUAL FLOW REGISTRATION UNIT
(FIG. 3)
8: FLOW DETECTION UNIT
9: FLOW CALCULATION UNIT
10: AVERAGE FLOW CALCULATION UNIT
11: FLOW STORAGE UNIT

12: FLOW CHANGE DETECTION UNIT
13: FLOW REGISTRATION UNIT
14: FLOW DIFFERENCE CORRECTION ESTIMATION UNIT
15: MONITORING CORRECTION UNIT
16: TIME MONITORING VALUE STORAGE UNIT
17: USE TIME ERROR DETERMINATION UNIT
18: SHUTOFF UNIT
19: NOTIFICATION UNIT
20: AVERAGE TIMEKEEPING UNIT
(FIG. 4)
8: FLOW DETECTION UNIT
9: FLOW CALCULATION UNIT
10: AVERAGE FLOW CALCULATION UNIT
11: FLOW STORAGE UNIT
12: FLOW CHANGE DETECTION UNIT
13: FLOW REGISTRATION UNIT
14: FLOW ESTIMATION UNIT
15: MONITORING VALUE STORAGE UNIT
16: ERROR DETERMINATION UNIT
17: SHUTOFF UNIT
19: REGISTRATION FLOW STORAGE UNIT

BEST MODE FOR CARRYING OUT THE INVENTION

According to a first aspect of the invention, a gas shutoff device for monitoring use statuses of a plurality of gas appliances connected to a pipe provided by being passed through a gas meter, and shutting the supply of gas when an error occurs, includes: a flow measurement unit for measuring an amount of gas passing through; an individual appliance calculation unit for calculating an increase/decrease in individual flow rate from a flow signal of the flow measurement unit and outputting the increased/decreased individual calculation flow rate of the appliance; an individual appliance registration maintenance unit for outputting a maximum individual flow signal output from the individual appliance calculation unit; an abnormal flow determination unit for determining an abnormal flow rate from the individual appliance registration maintenance unit; and a notification unit for giving a warning notification of an error upon receiving an error signal from the abnormal flow determination unit or a shutoff unit for shutting a gas passageway, wherein, when the individual calculation flow rate decreases, a flow rate regarded as the same is deleted from a registration unit of the individual appliance calculation unit and at the same time, flow registration is performed by a maintenance unit.

In addition, the registered flow rate that was deleted once due to the decrease in flow rate is maintained, and when it regarded as the same, re-registered, so that the simultaneous use of two or more appliances is prevented from being estimated as a single appliance, thereby preventing a security operation from being performed in a shorter time than the actual continuous time.

First Embodiment

Hereinafter, embodiments of a gas shutoff apparatus of the invention will be described with reference to the accompanying drawings.

A gas shutoff device according to a first embodiment will be described with reference to FIG. 1. In FIG. 1, reference numeral 1 denotes a flow measurement unit such as a flow sensor or an ultrasonic sensor mounted to a gas meter. Reference numeral 2 denotes a individual appliance calculation unit for calculating a flow signal of the flow measurement unit 1 as an average flow rate for a predetermined measurement period, calculating an increase/decrease in an individual flow used on the basis of the increase/decrease in the average flow rate, and outputting the increased/decreased individual calculation flow rate of an appliance. The individual calculation unit 2 calculates the individual appliances in use by determining that in the case where the average flow rate increases, a gas appliance is used on the basis of the increase, and determining that in the case where the average flow rate decreases, a gas appliance is stopped on the basis of the decrease. An individual appliance registration maintenance unit 3 registers flow rates Q1, Q2, and Q3 in a registration unit 31 in the case where an individual calculation flow rate Q output from the individual appliance calculation unit 2 is an increased flow rate, and, in the case where it is a decreased flow rate, deletes Q that is regarded as the same after being compared with the registration flow rates Q1, Q2, and Q3 from the registration unit 31, and at the same time, registers Qh1, Qh2, and Qh3 in a maintenance unit 32, thereby outputting a maximum individual flow signal. The individual appliance registration maintenance unit 3, in the case where there is no corresponding registration flow rate to be deleted when the decreased flow rate is received as the individual appliance calculation flow rate, deletes from the closest registration flow rates and maintains Qh1, Qh2, and Qh3, in the case where the maintained flow rates Qh1, Qh2, and Qh3 exist before re-registering the difference between the deleted registration flow rate and the decreased flow rate as an increased flow rate, compares them with flow rates Qh1, Qh2, Qh3, Qh1+Qh2, Qh2+Qh3, and Qh1+Qh2+Qh3, and when it is considered that (for example, the percentage matches) the flow rate is equal to one of them, registers Q1, Q2, and Q3 and deletes Qh1, Qh2, and Qh3 (for example, when it is matched with Qh2+Qh3, registers Qh2 and Qh3 as Q2 and Q3 and deletes Qh2 and Qh3). Reference numeral 4 denotes an abnormal flow determination unit for receiving the maximum individual flow signal from the individual appliance registration maintenance unit 3 and outputting an individual error signal in the case where the time of the use of the appliance is longer than a predetermined time. Reference numeral 5 denotes a notification unit for giving a warning notification of a gas flow error, or a shutoff unit for shutting a gas passageway, on the basis of receiving the individual error signal. In addition, the maximum individual flow signal may be output from the individual appliance registration maintenance unit 3 only when the maximum flow rates of the flow rates Q1, Q2, and Q3 registered are changed. A period for which the deleted flow rates Qh1, Qh2, and Qh3 are maintained may be until the registration flow rates are disappear (flow rates disappear), or only for a predetermined time. In addition, the number of flow rates that can be registered and maintained is not limited to 3.

The above-mentioned unit is easily implemented using calculations or determination functions of program operations by a microcomputer or suchlike.

Figure 2:
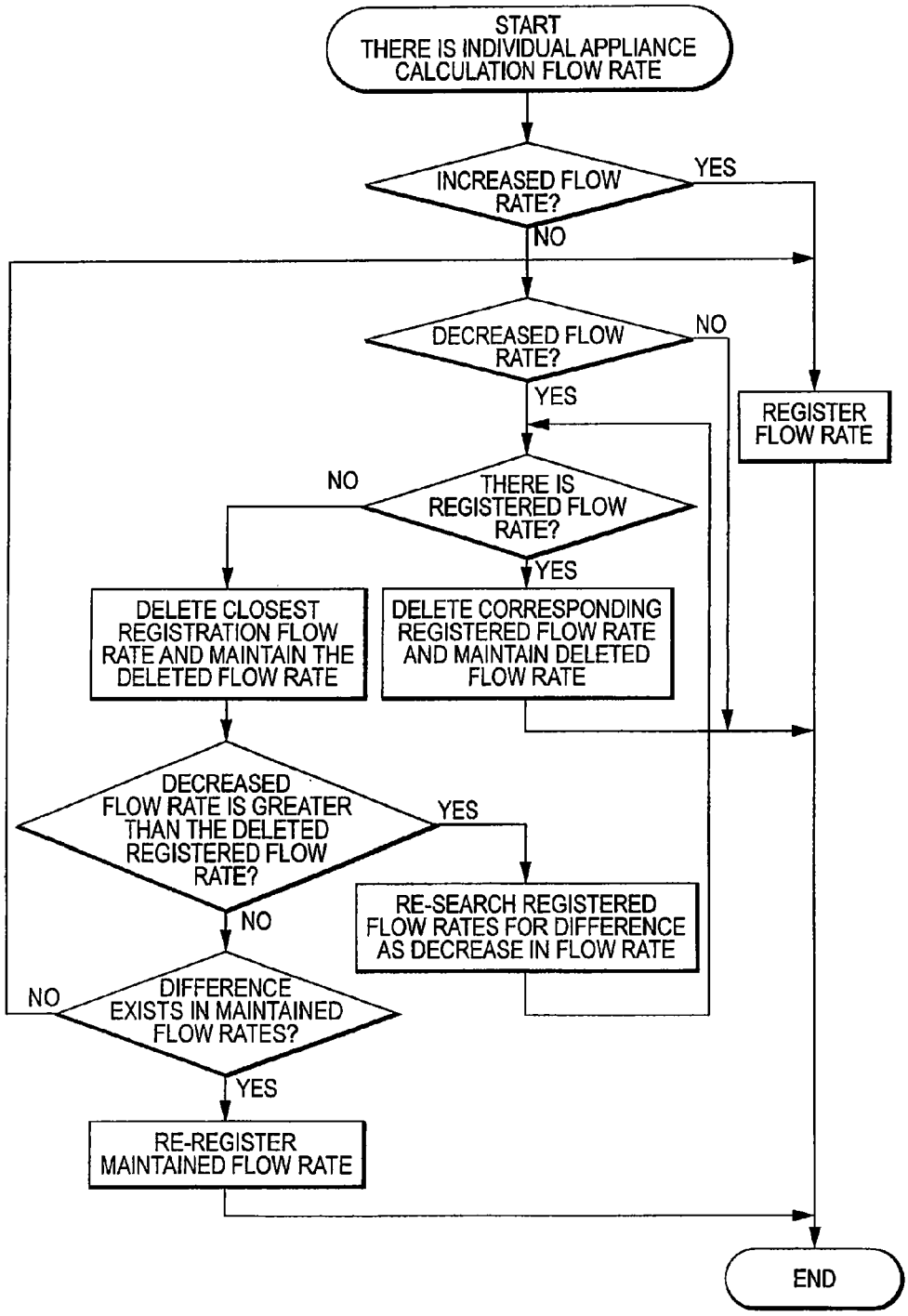
FIG. 2 is a flowchart of an individual appliance registration maintaining unit of the gas shutoff device according to the first embodiment of the invention.

FIG. 2 is a flowchart of flow registration, deletion, and maintenance procedures of the individual appliance registration maintenance unit 3 of the first embodiment.

When there is an individual calculation flow rate, it is determined whether or not it is an increased flow rate, and when it is the increased flow rate, Q1, Q2, and Q3 are registered. When the individual calculation flow rate is a decreased flow rate, it is compared with Q1, Q2, and Q3, and when there is a registered flow rate, the corresponding registered flow rate is deleted and the deleted registered flow rates are maintained as Qh1, Qh2, and Qh3. In addition, when there is no corresponding registered flow rate, the closest registered flow rate Qn is deleted, and the deleted registered flow rates are maintained as Qh1, Qh2, and Qh3. In the case where the deleted registered flow rate Qn is smaller than the decreased flow rate Q (in the case where Q-Qn is negative), it is re-compared with the registered flow rates Q1, Q2, and Q3, and when there is a registered flow rate, the corresponding flow rate is deleted and Qh1, Qh2, and Qh3 are maintained. In the case where the deleted registered flow rate Qn is greater than the decreased flow rate Q (in the case where Q-Qn is positive), it is compared with the maintained Qh1, Qh2, Qh3, Qh1+Qh2, Qh2+Qh3, and Qh1+Qh2+Qh3, and when it is considered that it is equal to one of them (for example, the percentages match), Q1, Q2, and Q3 are registered and Qh1, Qh2, and Qh3 are deleted (for example, when matched with Qh2+Qh3, Qh2 and Qh3 are registered as Q2 and Q3, and Qh2 and Qh3 are deleted). In the case where it is not equal to any one of the maintained sums of Qh1, Qh2, and Qh3, then Q1, Q2, and Q3 are registered as the increased flow rate.

Since the deleted registered flow rates Qh1, Qh2, and Qh3 are maintained as described above, although a plurality of registrations of appliances using small gas flow rates are deleted when flow control is performed on an appliance using a large gas flow rate, a plurality of registered flow rates can be re-registered not just as a single appliance when the flow of the appliance using the large gas flow rate is stopped, so that a suitable maximum individual flow signal is output to the abnormal flow determination unit to allow the abnormal flow determination unit to continuously perform a security calculation for a suitable use time.

In addition, in order to accomplish the object of the invention, included are: a flow detection unit for measuring a flow rate in a passage, a flow calculation unit for converting a detection value of the flow detection unit into a flow rate, an average timekeeping unit for counting an averaging time to obtain an average flow rate from the instantaneous flow rates, an average flow calculation unit for averaging the instantaneous flow rates obtained by the flow calculation unit at every predetermined time period, a flow storage unit for storing the values obtained by the average flow calculation unit, a flow change detection unit for determining whether or not there is a change in flow rate from the stored values of the average flow calculation unit and the flow storage unit, a flow registration unit for obtaining a change in the flow rate and registering the flow rate at the time of detecting the change from the flow change detection unit, a flow difference correction estimation unit for calculating a flow rate difference between the average flow rate obtained every average time and the sum of the registered flow rates and, in the case where there is a flow rate difference, re-correcting the flow rate registration value using the flow rate difference so as to be re-registered, a monitoring correction unit for performing use time monitoring correction in the case where the maximum registered flow rate value of the flow registration unit is corrected by the flow difference correction estimation unit, a time monitoring value storage unit for storing a determination value for monitoring the flow rate re-registered by the flow difference correction estimation unit, a use time error determination unit for determining an error by comparing the monitoring value with the registered flow rate value of the flow correction estimation unit and in the case where there is a signal output from the monitoring correction unit, not determining an update of the use time monitoring, and a shutoff unit for shutting the passage when the error is formed by the error determination unit.

In addition, the flow rate is detected by the flow detection unit when a gas appliance is used, and the average flow rate is obtained by the average flow calculation unit whenever the average timekeeping unit passes, so that although a new use is determined from a change in the use flow rate by the flow change detection unit and the change in the flow rate is registered by the flow registration unit, in the case of a small change in flow rate which is not determined as a flow rate change by the flow change detection unit under the control of the appliance itself, the sum flow rate and the sum of the total registered flow rates are compared regularly by the flow difference correction estimation unit every average time measured by the average timekeeping unit and the registered flow rate value is re-corrected and registered, and in the case where the registration of the largest flow rate is corrected by the flow registration unit, the use time error determination unit is not allowed to re-counted the use time by the monitoring correction unit so as to continuously perform use time monitoring. Accordingly, even though the flow rate actually used is changed, the flow rate can be accurately detected under the control of the appliance itself to determine whether or not there is an error, so that the safety margin is very high, utilization can be enhanced without the gas company coming out unnecessarily due to an error shutoff caused by an error in which the actual appliance flow rate is monitored as a different flow rate, thereby improving security.

Hereinafter, a second embodiment of the invention will be described with reference to FIG. 3. In addition, the invention is not limited by the embodiment.

Second Embodiment

Figure 3:
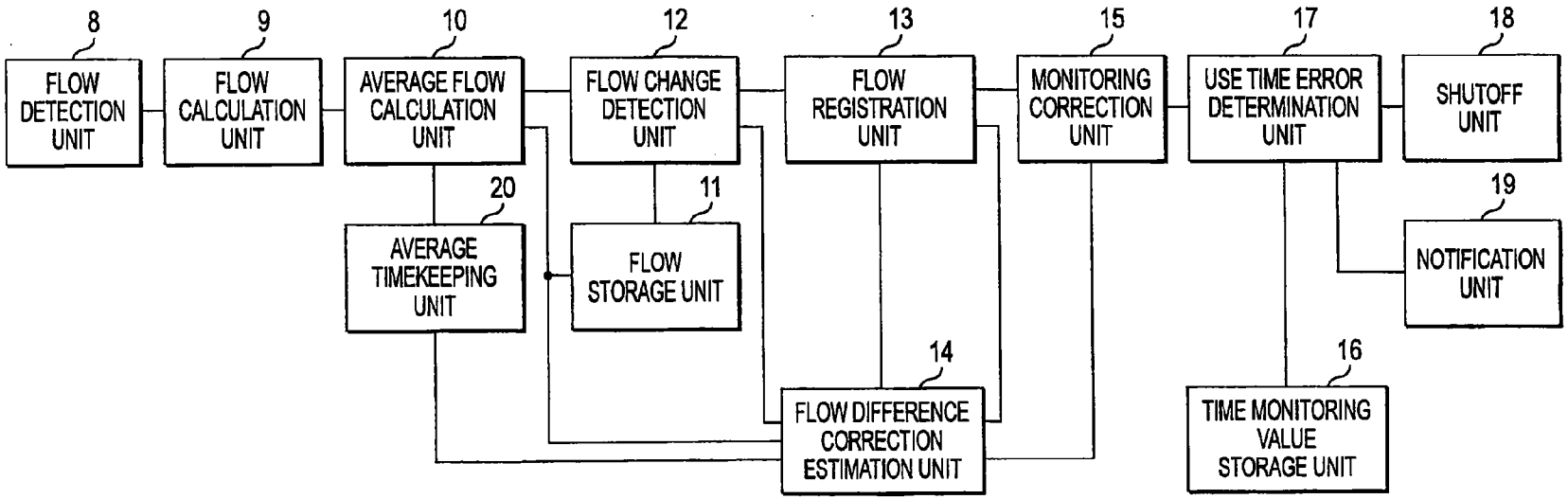
FIG. 3 is a control block diagram of a gas shutoff device according to a second embodiment of the invention.

FIG. 3 illustrates a gas shutoff device of the second embodiment of the invention.

In the figure, reference numeral 8 denotes the flow detection unit for detecting a gas flow rate in the passage of a gas medium such as city gas or LPG. For example, as examples of the flow detection unit 8, there include: detecting a flow rate gas used from a propagation time obtained by transmitting an ultrasonic signal of an ultrasonic sensor provided inside the passage from one side to the other side, a flow sensor which includes a hot-wire sensor in the passage for obtaining a flow rate from an impedance that changes due to a flow, and measuring the amount of gas used through a metering diaphragm and detecting a flow rate as an electrical pulse signal from a mechanical operation of the metering diaphragm by a magnet, a reed switch, or a magnetoresistive element.

Reference numeral 9 denotes a flow calculation unit for converting the signal obtained by the flow detection unit 8 into an instantaneous flow rate. For example, in the case of the ultrasonic sensor, the propagation time is converted into a flow rate. Reference numeral 10 denotes an average flow calculation unit for obtaining an average flow rate by collecting instantaneous flow rates obtained by the flow calculation unit 9 for a predetermined time or a predetermined number thereof. Reference numeral 11 denotes a flow storage unit for storing the obtained average flow rates in chronological order. Reference numeral 12 denotes a flow change detection unit for obtaining whether or not there is a change in the flow rate from the obtained average flow rate and the past flow rate value of the flow storage unit 11. For example, the use of an appliance is determined depending on whether or not the flow rate value is an arbitrary flow rate from zero when a consumer uses a water heater, or whether a change in flow rate from the obtained average flow rate or the past flow storage value when a water heater is used while another appliance is used is equal to or greater than a predetermined (rate or flow rate value). Reference numeral 13 denotes a flow registration unit for determining the use of an appliance and registering the change in flow rate when the change in the flow rate is detected by the flow change detection unit 12.

Reference numeral 14 denotes a flow difference correction estimation unit for obtaining a flow rate difference from the average flow rate obtained at the time of detecting the flow rate change and the sum of the total registered flow rates of the flow registration unit 13. When the flow rate difference is not zero or outside a predetermined range, the existence of a flow rate difference is determined and correction of the registered flow rate is performed. That is, the flow registration unit 13 re-registers the registered flow rate value according to the change in the flow rate at the time of detecting a change in the flow rate, and when there is a deviation between the total registered flow rate value and the actual flow rate due to the difference in the flow rate obtained at the time of detecting a change in the flow rate, the re-registered flow rate value is re-corrected and re-registered by using the difference in the flow rate.

Reference numeral 15 denotes a monitoring correction unit for outputting a signal for use time monitoring correction in the case where the maximum registered flow rate value of the flow registration unit 13 is corrected by the flow difference correction estimation unit 14.

Reference numeral 16 denotes a time monitoring storage unit for storing a limit value for use time shutoff of the flow rate of an appliance, or a monitoring determination value of the use maximum flow rate, for example, a sum shutoff flow rate value, an increased flow shutoff value, or the like, and storing a determination value of a limit time for the use time shutoff for monitoring the use time of the flow rate re-registered in the flow correction estimation unit 14.

Reference numeral 17 denotes a use time error determination unit for determining whether or not the amount of gas used registered in the flow registration unit 13 is in an abnormal use state by comparing it with the determination value of the time monitoring value storage unit 15. In addition, in the case where there is a signal input from the monitoring correction unit 15, it controls the use time monitoring while counting so as not to be updated.

For example, when a hose for supplying gas to an appliance in use such as a stove is disconnected for some reason, it is monitored by the use time error determination unit 17 by looking at the sum flow shutoff value for monitoring an abnormally large amount of flow, or a use time shutoff limit time for specifying a time limit for the use which corresponds to the case where an appliance is used for a much longer time than the maximum use time in general use. Reference numeral 18 is a shutoff unit for shutting the passage when an error is determined by the use time error determination unit 17 and a shutoff signal is output. Reference numeral 19 is a notification unit for displaying a shutoff state or shutoff contents on a liquid crystal display element or the like and notifying a center in charge of gas safety monitoring through telephone lines or the like in the case where the use time error detection unit 17 determines that the gas use state is abnormal and the shutoff unit 18 is operated.

In addition, reference numeral 20 denotes an average timekeeping unit, and when it counts a predetermined time, the average flow calculation unit 10 obtains an average flow rate on the basis of the instantaneous flow rates within the predetermined time, or the flow correction calculation unit 14 corrects the registered flow rate value from the flow rate difference between the average value and the sum of the registered flow rates of the flow registration unit 13.

Next, the operation of the configuration will be described. The flow rate of an appliance provided in a house consuming gas, for example, a gas stove or a water heater, is detected by the flow detection unit 8 when a consumer uses the appliance. A detection value obtained by regularly performing sampling is converted into an instantaneous flow rate by the flow calculation unit 9. In addition, the average timekeeping unit 20 counts time in order to average the instantaneous flow rates, and when a predetermined time elapses, the average flow calculation unit 10 obtains an average flow rate from a number of the instantaneous flow rates obtained within an average time. A plurality of the average flow rates are stored in the flow storage unit 11 regularly or in chronological order, and the flow change detection unit 12 detects the existence of a change in the flow rate from the past flow rates (for example, flow rate storage values at the previous time, at the time before last, and at the time before n times) stored in the flow storage unit. For example, when a user uses the water heater, in the case where the past flow rate is zero, it is changed to an arbitrary flow rate, and the change is obtained as a change in flow rate from the average flow rate and the past flow rate to register it as the existence of a change in the case where the change rate or the change amount is equal to or greater than a predetermined value, that is, as the use of an appliance in the flow registration unit 13. Otherwise, when the water heater is used during the use of the gas table, the gas table flow rate is stored as the past flow rate of the flow storage unit 10, and the flow change detection unit 12 obtains a change in flow rate from the average flow rate at this time and the past flow rate storage value and similarly registers the change in flow rate in the flow registration unit 13 as the existence of a change in the case where the change rate from the current flow rate or the change in flow rate is equal to or greater than a predetermined value. In addition to the case where the use of the appliance increases, when an appliance is stopped during the use of a plurality of appliances, the flow change detection unit 11 determines whether or not the change is a decrease from the past flow rate storage value and the average flow rate and outputs the decreased flow rate, and the flow registration unit 13 deletes the closest registered flow rate value from the registered flow rates as the decreased flow rates.

Before the flow registration unit 13 performs flow registration according to the change in the flow rate of the flow change detection unit 12, the following process is performed in advance. The flow correction estimation unit 14 performs the following process according to the output from the flow detection unit 12 whenever the average timekeeping unit 20 counts the average time. First, in the case where a change in flow rate is not detected, a plurality of the sums of the total registered flow rates registered in the flow registration unit 13 are stored in chronological order whenever the average flow calculation unit 10 obtains the average flow rate. A flow rate difference is obtained from the average flow rate and the sum of the total registered flow rates. When the flow rate difference is zero or in a predetermined range, the flow rate value registered in the flow registration unit 13 is determined as an actual flow rate of the total appliances used. In the case where the flow rate difference is not zero or in the predetermined range (change rate or flow rate range), that is, in the case where the flow rate difference exists, it is determined that an inaccurate flow rate is registered as the total registered flow rate value since the flow rate of the total appliances used is slightly changed, and a flow registration correction process is performed.

Simultaneously, the correction output is output to the monitoring correction unit 15. When the flow rate difference between the average flow rate and the sum of the total registered flow rates is positive, a slight increase is determined, and the difference is output and registered in the flow registration unit 13. On the contrary, in the case where flow rate difference is negative, a slight decrease caused by proportional control of the appliance is determined, and the flow rate difference is output to the flow registration unit 13 as a decreased flow rate to allow the flow registration unit 13 to perform decrease correction on the registered flow rate. Accordingly, a flow rate wrongly registered as a flow rate on the basis of a slight decrease that is not regarded as a change in flow rate can be reduced or deleted, so that the actually occurring flow and the sum of the registered flow rates become equal to each other. That is, it becomes a registered value corresponding to the actual flow rate used by the appliance.

When the flow registration unit 13 re-registers the maximum registered flow rate, it outputs a use time count continuation signal to the monitoring correction unit 15. When the maximum registered flow rate is updated in the flow change detection unit 12, the use time continuation signal is not output.

The subsequently registered flow rate value is compared with the storage value of the time monitoring value storage unit 16 by the use time error determination unit 17 to be monitored. A time limit for use time shutoff is stored in the time monitoring value storage unit 16. The use time error determination unit 17 counts a use time of the registered flow rate, compares/monitors it with the time limit corresponding to the flow rate range of the registered flow rate, and when it is greater, determines it as an abnormal flow rate and outputs a shutoff signal to the shutoff unit 18. Here, when the use time continuation signal is output from the monitoring correction unit 15, the use time is continuously counted. For a mere correction of a slight flow rate change in which a flow rate change is not caused by the control of an appliance, the counting of the use time is continued. When the counting of the use time is completed, the shutoff unit 18 is operated to close the passage and stop the supply of gas. In addition, when the shutoff signal is output, the shutoff content is displayed by the notification unit 19.

Generally, during hot water temperature control of a water heater, when it reaches a predetermined temperature, in the case where the amount used gradually decreases due to subsequent proportional control or the like, there is a case where the flow change detection unit 12 cannot detect this as a change in flow rate since the small change in flow rate is less than a predetermined change rate or less than a predetermined flow rate. Accordingly, the registered flow rate value registered in the flow registration unit 13 cannot be modified, so that the actual sum flow rate and the sum of the registered flow rate values are continuously in a non-matching state. Thereafter, when any of the appliances is stopped or there is a large change in flow rate, an appliance flow rate of which the changed flow rate is decreased to less than the flow registration value is searched, and a close appliance flow rate is then searched, thereby determining the appliance as 'stop' and deleting flow rate. Here, there was a case where a registered flow rate greater than the decreased flow rate is deleted, and there was a case where the flow rate difference between the registered flow rate and the decreased flow rate is excessively deleted, so that the flow rate was re-registered. As a result, there was a problem in that the flow rate is wrongly registered, the use time is monitored by the error determination unit 17, and it is wrongly regarded as a flow rate in a flow classification that does not originally exist and the use time is shutoff. However, whenever the average flow calculation unit 10 obtains the average flow rate every average time, the flow difference correction estimation unit 14 obtains the flow rate difference from the sum of the total flow rates registered in the flow registration unit 13, and the registered flow rate is corrected and re-registered in the flow registration unit 13 as the decreased flow rate. At the time of detecting the change in flow rate, there is no case in which a state where the flow rate difference at the previous time point is zero or in a predetermined range and a flow rate that does not substantially exist is registered as a registered flow rate value. In the case where the maximum registered flow is corrected by the flow correction estimation unit 14, the monitored use time is continuously counted. Due to a small decrease in flow rate due to the control of the appliance, the counting of the use time is continued.

In this manner, a problem in which the flow rate at the time of registration is not modified even though the actual flow rate gradually decreases and becomes smaller is improved, and use time monitoring is continued without re-counting at the original accurate flow rate, so that it is possible to prevent a mistaken shutoff in a short time and a mistaken warning such as giving a use time warning notification for an appliance that is not originally used, thereby significantly improving safety and security reliability.

In order to accomplish the object of the invention, included are: a flow detection unit for measuring a flow rate in a passage, a flow calculation unit for converting a detection value of the flow detection unit into a flow rate, an average flow calculation unit for averaging instantaneous flow rates obtained by the flow calculation unit, a flow storage unit for storing the average flow rate values obtained by the average flow calculation unit, a flow change detection unit for determining whether or not there is a change in flow rate from the stored values of the average flow calculation unit and the flow storage unit, a flow registration unit for obtaining and registering a change in flow rate when the flow change detection unit determines a "flow change existence", a registration flow storage unit for storing the average flow rate at the time of flow registration, a flow estimation unit for, when the "flow change existence" is re-determined by the flow change detection unit, calculating a flow rate difference between the average flow rate at the time of determination and the average flow rate of the registration flow storage unit, and when there is a flow rate difference, outputting the average flow rate of the registration flow storage unit for the calculation of a flow registration value, a monitoring value storage unit for storing a determination value for monitoring the flow rate registered in the flow registration unit, an error determination unit for determining an error by comparing the monitoring value with the registered flow rate value, and a shutoff unit for shutting the passage when error determination is formed by the error determination unit.

When a gas appliance is used, the flow rate is detected by the flow detection unit and the average flow rate is obtained by the average flow calculation unit, and although a new use is determined from a change in variable flow rate by the flow change detection unit and the change in the flow rate is registered in the flow registration unit, there is a case where there is a small change in flow rate which is not determined as a flow rate change by the flow change detection unit under the control of the appliance itself, so that in the case where the average flow rate at the time of flow registration is stored by the flow estimation unit to be always compared with the average flow rate obtained for a flow change non-detection period, and there is a flow rate difference that is more than a predetermined range, the average flow rate stored after detecting the flow rate change is output for re-registration calculation to the flow registration unit to re-fix the registered flow rate value. Accordingly, whether or not there is an error can be monitored by accurately detecting the flow rate even when the amount of actual usage is changed by the control of the appliance itself, so that safety is very high, utilization can be enhanced without the gas company coming out unnecessarily due to an error shutoff caused by an error in which the actual appliance flow rate is monitored as a different flow rate, thereby improving security.

A third embodiment of the invention will be described with reference to FIG. 4. In addition, the invention is not limited by the embodiment.

Third Embodiment

Figure 4:
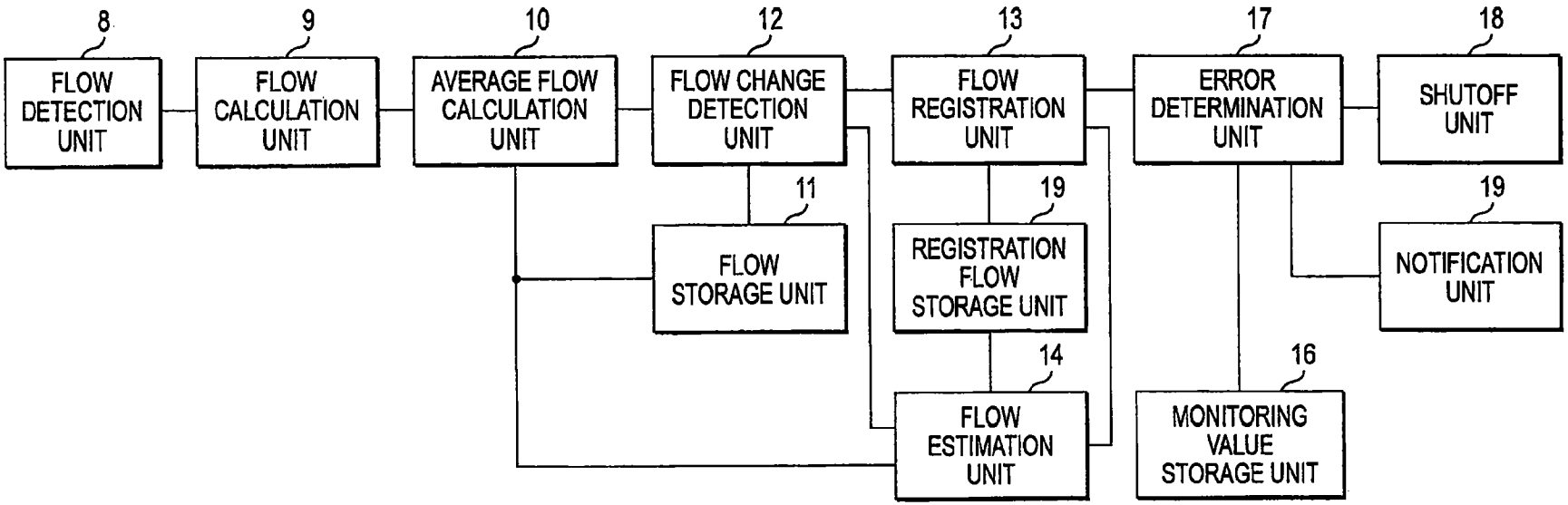
FIG. 4 is a control block diagram of a gas shutoff device according to a third embodiment of the invention.
Figure 5:
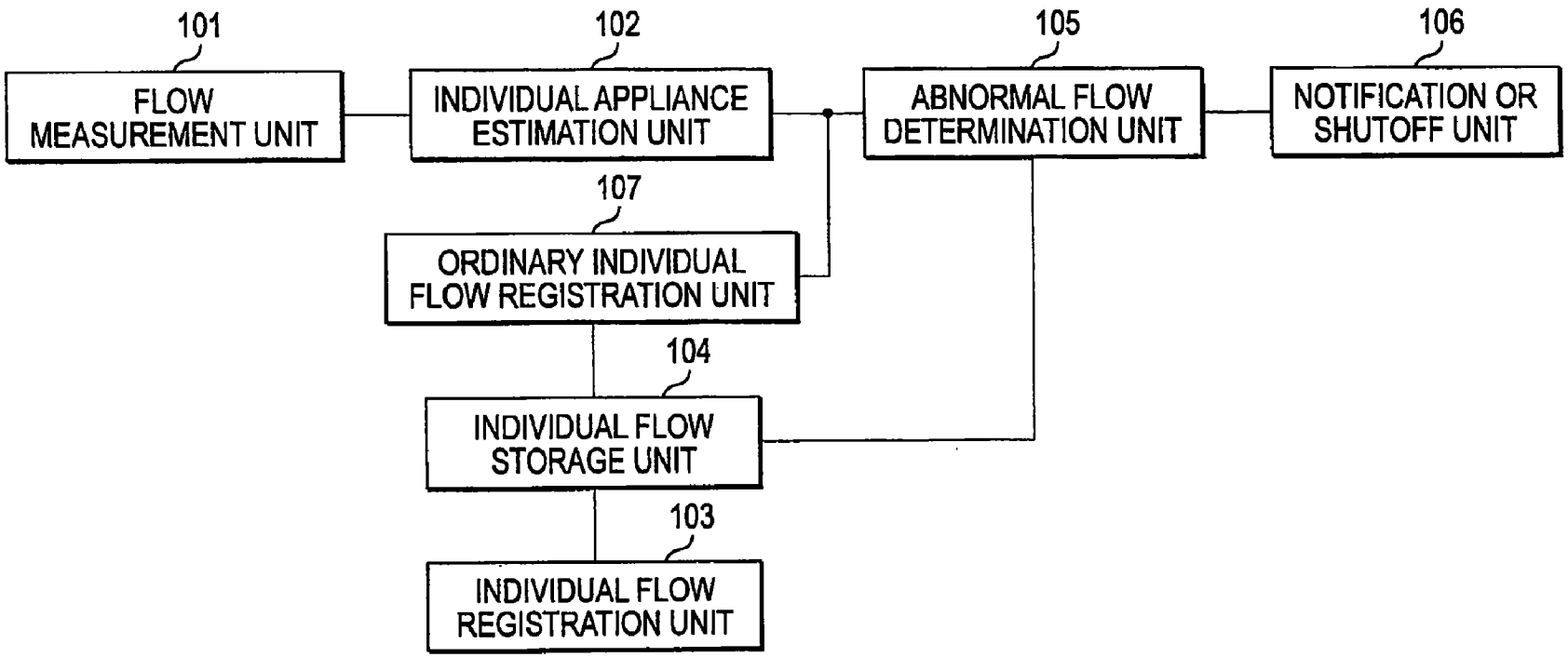
FIG. 5 is a control block diagram of a conventional gas shutoff device.
Figure 6:
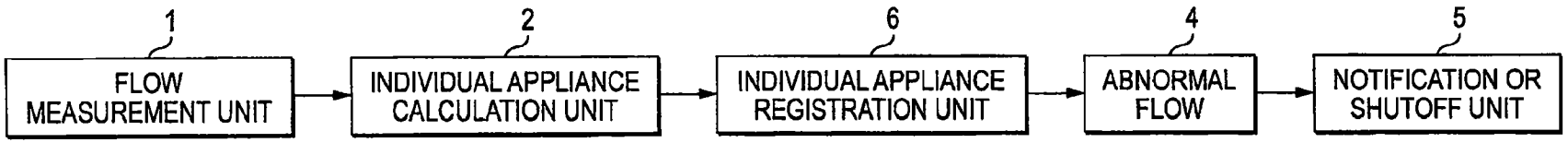
FIG. 6 is a block diagram of a conventional gas shutoff device.
Figure 7:
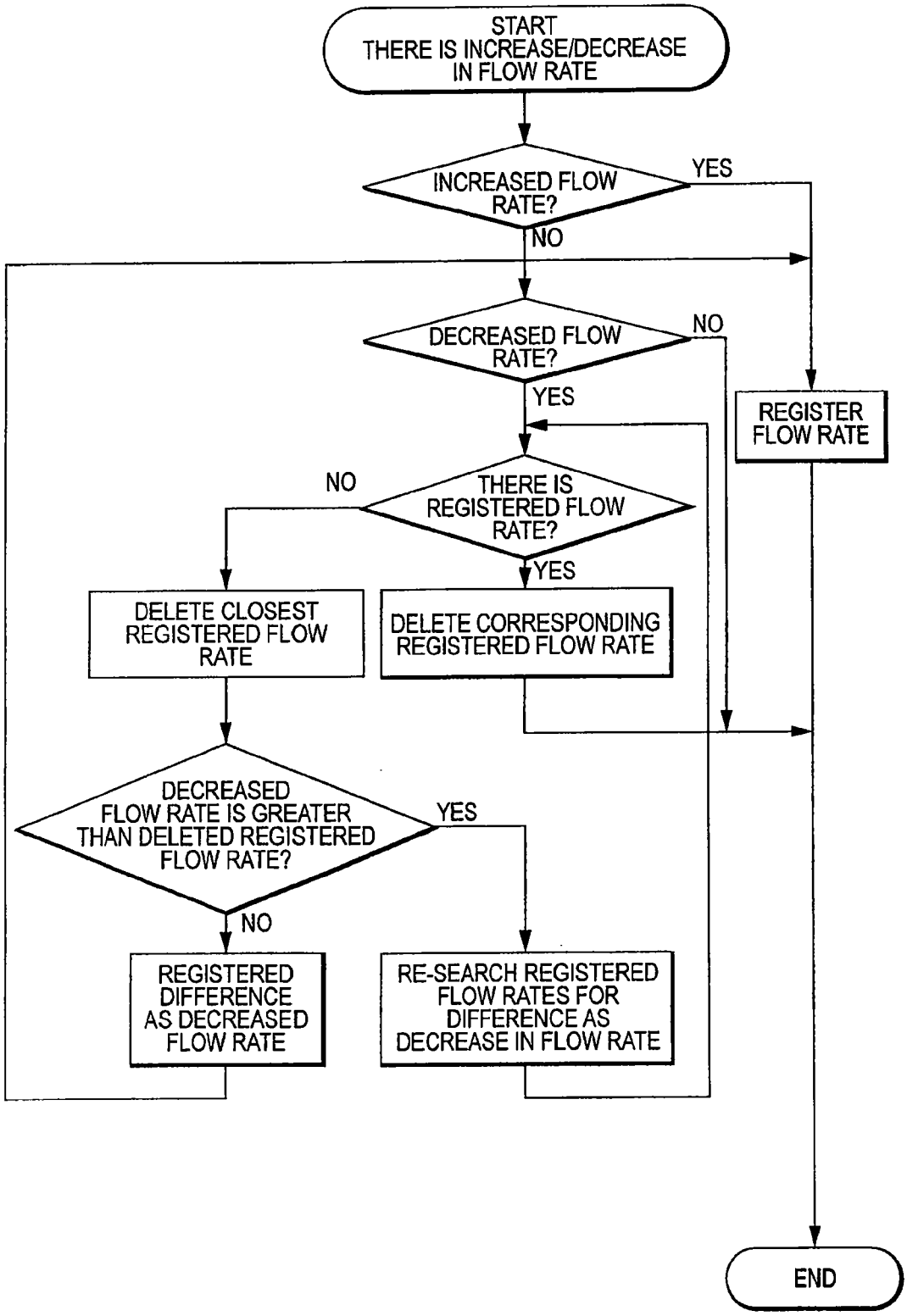
FIG. 7 is a flowchart of an individual appliance registration unit of the conventional gas shutoff device.

FIG. 4 illustrates a gas shutoff device of the third embodiment of the invention.

In the figure, reference numeral 8 denotes a flow detection unit for detecting a gas flow rate in the passage of a gas medium such as city gas or LPG. For example, as examples of the flow detection unit 17, there include: detecting a flow rate gas used from a propagation time obtained by transmitting an ultrasonic signal of an ultrasonic sensor provided inside the passage from one side to the other side, a flow sensor which includes a hot-wire sensor in the passage for obtaining a flow rate from an impedance that changes due to a flow, and measuring the amount of gas used through a metering diaphragm and detecting a flow rate as an electrical pulse signal from a mechanical operation of the metering diaphragm by a magnet, a reed switch, or a magnetoresistive element.

Reference numeral 9 denotes a flow calculation unit for converting the signal obtained by the flow detection unit 8 into an instantaneous flow rate. For example, in the case of the ultrasonic sensor, the propagation time is converted into a flow rate. Reference numeral 10 denotes an average flow calculation unit for obtaining an average flow rate by collecting a predetermined number of instantaneous flow rates obtained by the flow calculation unit 9.

Reference numeral 11 denotes a flow storage unit for storing the obtained average flow rates in chronological order. Reference numeral 12 denotes a flow change detection unit for detecting whether or not there is a change in the flow rate from the obtained average flow rate and the past flow rate value of the flow storage unit 11. For example, the use of an appliance is determined depending on whether or not the flow rate value is an arbitrary flow rate from zero when a consumer uses a water heater, or whether a change in flow rate from the obtained average flow rate or the past flow storage value when a water heater is used while another appliance is used is equal to or greater than a predetermined (rate or flow rate value). Reference numeral 13 denotes a flow registration unit for, after the change in the flow rate is detected by the flow change detection unit 12, obtaining the change in flow rate (difference) from the obtained average flow rate and the average flow rate stored in the flow storage unit 11 and registering the change in the flow rate as a flow rate of a newly used appliance.

Reference numeral 19 denotes a registration flow storage unit for storing an average flow rate for obtaining the change in the flow rate to be registered in the flow registration unit 13 when the flow change detection unit 12 determines "change existence".

Reference numeral 14 denotes a flow estimation unit for, after the average flow rate is stored in the registration flow storage unit 19, comparing the stored average flow rate with the obtained average flow rate while the next change in flow is detected, and determining whether or not the flow rate difference is inside or outside a predetermined range. When it is determined that it is outside the predetermined range until the flow change detection, the stored average flow rate is output to the flow registration unit 13. The flow registration unit 13 generally obtains and registers a change in the flow rate from the past average flow rate stored in the flow storage unit 11 after the flow change detection unit 12 detects a change and the average flow rate obtained by the average flow calculation unit 10 at this time. This registration includes cases of new registration, or cases of reducing or deleting a flow rate value registered in advance since an appliance is stopped.

On the other hand, when the flow estimation unit 14 determines that the flow rate difference is outside the predetermined rate, the average flow rate stored at the time of registration after detecting a change in flow rate at the previous time is output to the flow registration unit 13. The flow registration unit 13 obtains the change in flow rate from the stored average flow rate and the average flow rate obtained at this time and re-registers the registered flow rate value. Here, the flow registration unit 13 registers a flow rate registered after detecting the change in flow rate at the previous time, and calculates and registers it as a change in flow rate from the sum of the registered flow rates.

Reference numeral 15 denotes a monitoring value storage unit for storing a time limit for use time shutoff of the flow rate of an appliance or a monitoring determination value of a use maximum flow rate, for example, a sum shutoff flow rate or an increased flow rate shutoff value. Reference numeral 16 denotes an error determination unit for determining whether or not an amount of gas used registered in the flow registration unit 13 is in an abnormal use state, as the determination value of the monitoring value storage unit 15. For example, when a hose for supplying gas to an appliance in use such as a stove is disconnected for some reason, it is monitored by the use time error determination unit 16 by looking at the sum flow shutoff value for monitoring an abnormally large amount of flow, or a use time shutoff limit time for specifying a time limit for the use which corresponds to the case where an appliance is used for a much longer time than the maximum use time in general use.

Reference numeral 17 denotes a shutoff unit for shutting the passage when an error is determined by the error determination unit 16 and a shutoff signal is output. Reference numeral 18 is a notification unit for displaying a shutoff state or a shutoff content on a liquid crystal display element or the like and notifying a center in charge of gas safety monitoring through telephone lines or the like in the case where the error detection unit 16 determines that the gas use state is abnormal and the shutoff unit 17 is operated.

Next, the operation of the combination will be described. The flow rate of an appliance provided in a house consuming gas, for example, a gas stove or a water heater is detected by the flow detection unit 8 when a consumer uses the appliance. A detection value obtained by regularly performing sampling is converted into an instantaneous flow rate by the flow calculation unit 9. The average flow calculation unit 10 obtains an average flow rate from a number of instantaneous flow rates. A plurality of the average flow rates are stored in the flow storage unit 11 regularly or in chronological order, and the flow change detection unit 12 obtains existence of a change in the flow rate from the past flow rates (for example, flow rate storage values at the previous time, at the time before last, or at the time before n times) stored in the flow storage unit.

For example, when a user uses the water heater, in the case where the past flow rate is zero, it is changed to an arbitrary flow rate, and the change is obtained as a change in flow rate from the average flow rate and the past flow rate to register it as the existence of a change in the case where the change rate or the change amount is equal to or greater than a predetermined value, that is, as the use of an appliance in the flow registration unit 13. Otherwise, when the water heater is used during the use of the gas table, the gas table flow rate is stored as the past flow rate of the flow storage unit 10, and the flow change detection unit 12 obtains a change in flow rate from the average flow rate at this time and the past flow rate storage value and similarly registers the change in flow rate in the flow registration unit 13 as the existence of a change in the case where the change rate or the change in flow rate is equal to or greater than a predetermined value.

In addition to the case where the use of the appliance increases, when an appliance is stopped during the use of a plurality of appliances or the flow rate changes, the flow change detection unit 11 determines whether or not the change is a decrease from the past flow rate storage value and the average flow rate and outputs the decreased flow rate, and the flow registration unit 13 deletes or reduces the closest registered flow rate value from the registered flow rates as the decreased flow rates. Generally, a change in flow rate is obtained and registered from the past average flow rate stored in the flow storage unit 11 after the flow change detection unit 12 detects a change and the average flow rate obtained by the average flow calculation unit 10 at this time. This registration process includes a case of flow rate registration of a new change in flow rate (increment), or a case of reducing or deleting a flow rate value registered in advance since an appliance is stopped.

When the registered flow rate value is set in the flow registration unit 13, the average flow rate value at this time is stored in the registration flow storage unit 19, and the flow estimation unit 14, after the average flow rate is stored in the registration flow storage unit 19, compares the stored average flow rate and the obtained flow rate while a next change in flow is detected and determines whether the flow difference is inside or outside a predetermined range. There is a decrease which is not detected as a change in flow rate by the control of the appliance itself, and in this case, outside the range is determined.

In addition, when it is determined that it is outside the predetermined range until the next change in flow rate is detected, the stored average flow rate is output to the flow registration unit 13. The flow registration unit 13 obtains a change in flow rate from the average flow rate registered at the time of flow registration after the flow change detection unit 12 detects a change and the average flow rate obtained by the average flow calculation unit 10 at this time and performs registration processing.

In the case where a flow rate difference between the average flow rate and the sum of the total registered flow rates is positive, a slight increase is determined, and the difference is output and registered in the flow registration unit 13. On the contrary, in the case where flow rate difference is negative, a slight decrease caused by proportional control of the appliance is determined, the change in flow rate is output to the flow registration unit 13 as a decreased flow rate to allow the flow registration unit 13 to perform decrease correction on the registered flow rate. Accordingly, a flow rate wrongly registered as if there is a flow rate by a slight decrease that is not regarded as a change in flow rate can be reduced or deleted, so that the flow that actually occurs and the sum of the registered flow rates become equal to each other. That is, it becomes a registered value corresponding to the actual flow rate used by the appliance.

Next, the registered flow rate value is compared and monitored with the storage value of the monitoring value storage unit 15 by the error determination unit 16. The monitoring value storage unit 15 stores a sum flow shutoff value, an increase flow shutoff value, or a time limit of use time shutoff. The error determination unit 16 compares the registered flow rate with the sum of monitoring determination value of the monitoring value storage unit 15 or the increase flow shutoff value. In the case where it does not corresponding this, the error determination unit 16 counts a use time of the registered flow rate, compares and monitors a time limit corresponding to the flow rate range of the registered flow rate, and when it is in excess, determines an abnormal flow rate and outputs a hasty conclusion signal to the shutoff signal 17. Therefore, the shutoff unit 17 is operated to close the passage and stop the supply of gas. In addition, when the shutoff signal is output, the shutoff content is displayed on the notification unit 18.

Generally, during hot water temperature control of a water heater, when it reaches a predetermined temperature, in the case where an amount used gradually decreases due to subsequent proportional control or the like, there is a case where the flow change detection unit 11 cannot detect it as a change in flow rate since the small change in flow rate is less than a predetermined change rate or less than a predetermined flow rate. Accordingly, the registered flow rate value registered in the registration unit 13 cannot be modified, so that the actual sum flow rate and the sum of the registered flow rate value are continuously in a non-matching state.

Thereafter, when any of the appliances is stopped or there is a large change in flow rate, an appliance flow rate of which the changed flow rate is decreased to less than the flow registration value is searched, and a close appliance flow rate is then searched, thereby determining the appliance as 'stop' and deleting the flow rate. Here, there was a case where a registered flow rate greater than the decreased flow rate is deleted, and there was a case where the flow rate difference between the registered flow rate and the decreased flow rate is excessively deleted, so that the flow rate was re-registered. As a result, there was a problem in that the flow rate is wrongly registered, the use time is monitored by the error determination unit 16, and it is wrongly regarded as a flow rate in a flow classification that does not originally exist and the use time is shut.

However, in the case where the average flow rate at the time of flow registration after the change in flow rate is detected is stored in the registration flow storage unit 19, and thereafter, a change in difference between the average flow rate obtained by the average flow calculation unit 10 at every time and the average flow rate stored in the registration flow storage unit 19 is not in the predetermined range, the average flow rate stored at the time of previous registration in the flow registration unit 13 is output from the flow estimation unit 14 and calculated as the change in flow rate from the time of registration, so that the sum of the registered flow rate values becomes equal to the actual flow rate (obtained by the average flow rates). That is, the flow rate value before the slight change is registered as the registered flow rate value, the change in flow rate is obtained from the time point, and a flow rate corresponding to the change in flow rate, the closest flow rate is reduced or deleted from the flow registration values.

A problem in which the flow rate at the time of registration has not been modified although the actual flow rate gradually decrease can be improved, and use time monitoring can be performed on the basis of the original accurate flow rate, so that it is possible to prevent a mistaken shutoff in a short time and a mistaken warning such as giving a use time warning notification for an appliance that is not originally used, thereby significantly improving safety and security reliability.

Priority is claimed on Japanese Patent Application No. 2007-182929, filed on Jul. 12, 2007, the contents of which are incorporated herein by reference.

INDUSTRIAL APPLICABILITY

As described above, the gas shutoff device related to the invention maintains the registered flow rate that was deleted once due to a decrease in flow rate, and when it regarded to be the same, re-register it, thereby preventing the simultaneous use of two or more appliances from being estimated as a single appliance. Accordingly, performing a security operation for a shorter time than the actual continuous time can be prevented, so that it can be applied to the entire appliance monitoring devices.

In addition, as described above, the gas shutoff device related to the invention can be applied to purposes such as gas metering of various gas media, LP gas, city gas, or hydrogen gas flowing through a pipe using a diaphragm type, ultrasonic sensor, a hot-wire sensor, a fluidic sensor, or the like, or water meters for metering liquids such as water using an ultrasonic sensor or the like.

The invention claimed is:

1. A gas shutoff device for monitoring use statuses of a plurality of gas appliances connected to a pipe provided by being passed through a gas meter, and shutting the supply of gas when an error occurs, comprising:

a flow measurement unit for measuring an amount of gas passing through;

an individual appliance calculation unit for calculating a change in individual flow rate of an appliance among the plurality of gas appliances based on a flow signal of the flow measurement unit and outputting the calculated change in individual flow rate of the appliance;

an individual appliance registration maintenance unit for outputting a maximum individual flow signal output from the individual appliance calculation unit;

an abnormal flow determination unit for determining an abnormal flow rate from the individual appliance registration maintenance unit; and a notification unit for giving a warning notification of an error upon receiving an error signal from the abnormal flow determination unit or a shutoff unit for shutting a gas passageway, wherein the individual appliance registration maintenance unit includes a registration unit and a maintenance unit, wherein the individual appliance registration maintenance unit registers flow rates in the registration unit when an individual calculation flow rate output from the individual appliance calculation unit is an increased flow rate, and deletes an individual calculation flow rate that is regarded as the same after being compared with the registration flow rates from the registration unit and at the same time, registers the deleted flow rates in the maintenance unit when the individual calculation flow rate output from the individual appliance calculation unit is a decreased flow rate.

2. A program stored on a non-transitory memory for causing a computer to function as all or parts of the units of the shutoff device according to claim 1.

3. A gas shutoff device comprising:

a flow detection unit for measuring a flow rate in a passage;

a flow calculation unit for converting a detection value of the flow detection unit into instantaneous flow rates;

an average timekeeping unit for counting an averaging time to obtain an average flow rate from the instantaneous flow rates;

an average flow calculation unit for averaging the instantaneous flow rates obtained by the flow calculation unit at every predetermined time period, a flow storage unit for storing the average flow rate values obtained by the average flow calculation unit;

a flow change detection unit for determining whether or not there is a change in flow rate from the stored average values of the average flow calculation unit and the flow storage unit;

a flow registration unit for obtaining a change in the flow rate and registering the flow rate at the time of detecting the change from the flow change detection unit;

a flow difference correction estimation unit for calculating a flow rate difference between the average flow rate obtained at every average time and the sum of registered flow rates and, in the case where there is the flow rate difference, re-correcting the registered flow rate value in the flow registration unit by an amount of the flow rate difference so as to be re-registered in the flow registration unit;

a monitoring correction unit for performing use time monitoring correction in the case where the maximum registered flow rate value in the flow registration unit is corrected by the flow difference correction estimation unit;

a time monitoring value storage unit for storing a monitoring value for monitoring the registered flow rate value in the flow registration unit that is re-registered by the flow difference correction estimation unit;

a use time error determination unit for determining an error by comparing the monitoring value with the registered flow rate value in the flow registration unit that is re-registered by the flow correction estimation unit and in the case where there is a signal output from the monitoring correction unit, not determining an update of the use time monitoring, and a shutoff unit for shutting the passage when the error is confirmed by the error determination unit.

4. A gas shutoff device comprising:

a flow detection unit for measuring a flow rate in a passage;

a flow calculation unit for converting a detection value of the flow detection unit into a flow rate, an average flow calculation unit for averaging instantaneous flow rates obtained by the flow calculation unit;

a flow storage unit for storing the average flow rate values obtained by the average flow calculation unit;

a flow change detection unit for determining whether or not there is a change in flow rate from the stored values of the average flow calculation unit and the flow storage unit;

a flow registration unit for obtaining and registering a change in flow rate when the flow change detection unit determines that there is a change in flow rate;

a registration flow storage unit for storing the average flow rate at the time of registration of the change in flow rate by the flow registration unit;

a flow estimation unit for, when the flow change detection unit subsequently determines whether or not there is a change in flow rate, calculating a flow rate difference between the average flow rate at the time of determination and the average flow rate of the registration flow storage unit, and when there is a flow rate difference, outputting the average flow rate of the registration flow storage unit to the flow registration unit for the calculation of registered flow rate values;

a monitoring value storage unit for storing a monitoring value for monitoring the flow rate registered in the flow registration unit;

an error determination unit for determining an error by comparing the monitoring value with the registered flow rate value; and a shutoff unit for shutting the passage when error is confirmed by the error determination unit.

* * * * *